US011749110B2

(12) United States Patent
Wan et al.

(10) Patent No.: US 11,749,110 B2
(45) Date of Patent: Sep. 5, 2023

(54) VIRTUAL PARKING SPACE ESTABLISHMENT SYSTEM AND METHOD BASED ON MULTI-SOURCE DATA FUSION

(71) Applicant: Ningbo University of Technology, Ningbo (CN)

(72) Inventors: Yan Wan, Ningbo (CN); Feifei Xu, Ningbo (CN); Sheng Dong, Ningbo (CN); Honghua Xu, Ningbo (CN); Qinzheng Liu, Ningbo (CN); Yikang Fan, Ningbo (CN); Weijia Wu, Ningbo (CN); Rui Li, Ningbo (CN); Yangzheng Lin, Ningbo (CN); Haotian Zheng, Ningbo (CN)

(73) Assignee: Ningbo University of Technology, Ningbo (CN)

( * ) Notice: Subject to any disclaimer, the term of this patent is extended or adjusted under 35 U.S.C. 154(b) by 0 days.

(21) Appl. No.: 18/152,197

(22) Filed: Jan. 10, 2023

(65) Prior Publication Data

US 2023/0222913 A1 Jul. 13, 2023

(30) Foreign Application Priority Data

Jan. 11, 2022 (CN) ..... 202210027056.0

(51) Int. Cl.
*G08G 1/14* (2006.01)
*G08G 1/065* (2006.01)

(52) U.S. Cl.
CPC ..... *G08G 1/148* (2013.01); *G08G 1/065* (2013.01); *G08G 1/147* (2013.01)

(58) Field of Classification Search
CPC ..... G08G 1/148; G08G 1/065; G08G 1/147
See application file for complete search history.

(56) References Cited

U.S. PATENT DOCUMENTS

2018/0253970 A1* 9/2018 Murphy ..... G06Q 10/10
2020/0079357 A1 3/2020 Kline
(Continued)

FOREIGN PATENT DOCUMENTS

CN 103942977 A 7/2014
CN 106297384 A 1/2017
(Continued)

OTHER PUBLICATIONS

Ruixue et al. "Design of Parking Spaces Seeking System on Smart Phones Based on Internet Plus" Transport Development and Reform Topics 2018.

(Continued)

*Primary Examiner* — Joseph H Feild
*Assistant Examiner* — Sharmin Akhter

(57) ABSTRACT

Disclosed are a virtual parking space establishment system and a method. The virtual parking space establishment system includes a data acquiring module, a data processing module, a parking space control module, a wireless communication module and a client; the data acquiring module is used for acquiring traffic flow data; the data processing module is used for processing and analyzing the traffic flow data; the parking space control module is used for establishing or canceling virtual parking spaces according to analysis results of the traffic flow data; the wireless communication module is used for providing a wireless network link between the client and the parking space control module; the client is used for viewing virtual parking space information.

2 Claims, 2 Drawing Sheets

(56) References Cited

U.S. PATENT DOCUMENTS

| | | | | |
|---|---|---|---|---|
| 2020/0242924 | A1* | 7/2020 | Publicover | G08G 1/087 |
| 2022/0044558 | A1* | 2/2022 | Li | G08G 1/017 |

FOREIGN PATENT DOCUMENTS

| | | | |
|---|---|---|---|
| CN | 107545769 | A | 1/2018 |
| CN | 109598975 | A | 4/2019 |
| CN | 110264780 | A | 9/2019 |
| WO | 2016203422 | A1 | 12/2016 |

OTHER PUBLICATIONS

Author: Tian Lin "Design of Roadside Parking Management System Based on the Smart Parking Lock" Chinese Excellent Master's dissertation Full-text Database Engineering Science and Technology II, May 27, 2020.

Unknown, "Parking Guidance system in IOT mode" Intelligent Processing and Application, 2019, 4 pages.

* cited by examiner

VIRTUAL PARKING SPACE ESTABLISHMENT SYSTEM AND METHOD BASED ON MULTI-SOURCE DATA FUSION

CROSS-REFERENCE TO RELATED APPLICATIONS

This application claims priority to Chinese Patent Application No. 202210027056.0, filed on Jan. 11, 2022, the contents of which are hereby incorporated by reference.

TECHNICAL FIELD

The application belongs to the technical field of virtual parking spaces, and in particular to a virtual parking space establishment system and a method based on multi-source data fusion.

BACKGROUND

China is a populous country. With the popularization of private cars and the serious shortage of parking spaces in cities, the difficulty in parking has become a major problem that puzzles people. However, in some time periods, the road traffic rate is very low, and a large number of roads are idle because they are not fully utilized. And a large number of vehicles illegally parked on sidewalks or roadside with unplanned parking spaces also cause problems in urban road administration. Random parking negatively affects the urban appearance, and unplanned parking is easy to cause more traffic problems.

At present, the existing intelligent parking system and method divide idle roads into tidal parking spaces by time periods, so that users park their vehicles in a planned way. Thus, although the road utilization rate is improved and the parking difficulty problem is alleviated, the divided peak time periods and flat peak time periods are all fixed time periods, and some unexpected traffic conditions are not taken into account, lacking intelligent administration of road parking. Then road congestion is easy to trigger when the traffic flow increases unexpectedly during the permitted parking period, while the road utilization rate is low when the traffic flow is small during no-parking time period. Therefore, the existing road parking methods are not intelligent enough, have limited improved road utilization rates, and fail to solve the problem of parking difficulty and road congestion to the maximum extent.

Therefore, it is urgent to provide a scheme to detect the traffic flow status of roads in real time and dynamically divide idle roads into virtual parking spaces, so as to build virtual parking spaces when there is small traffic flow and cancel the virtual parking spaces in time when there is large traffic flow, thus paring vehicles in a planned way, maximizing the road utilization rate and alleviating the problems of parking difficulties and road congestion.

SUMMARY

To solve the above problems, the present application provides a virtual parking space establishment system and a method based on multi-source data fusion, realizing that the establishment and cancellation of virtual parking spaces change with the change of real-time traffic flow on roads, and improving the utilization rate of road resources to the greatest extent on the premise of ensuring smooth road traffic.

On the one hand, to achieve the above objectives, the application provides the virtual parking space establishment system based on multi-source data fusion, including a data acquiring module, a data processing module, a parking space control module, a wireless communication module and a client, where the data acquiring module is used for acquiring traffic flow data;

the data processing module is used for processing and analyzing the traffic flow data;

the parking space control module is used for establishing or canceling virtual parking spaces according to analysis results of the traffic flow data;

the wireless communication module is used for providing a wireless network link between the client and the parking space control module;

the client is used for viewing virtual parking space information.

Optionally, the data acquiring module includes a geomagnetic sensing unit and a high-definition camera unit;

the geomagnetic sensing unit is used for acquiring first traffic flow data through real-time geomagnetic induction, where the first traffic flow data is traffic flow data of vehicles passing through the geomagnetic sensing unit;

the high-definition camera unit is used for acquiring second traffic flow data through real-time video monitoring, where the second traffic flow data is all traffic flow data on roads.

Optionally, the data processing module includes a first judging unit, a second judging unit and a threshold setting unit;

the threshold setting unit is used for setting a first preset traffic flow threshold and a second preset traffic flow threshold;

the first judging unit is used for comparing the first traffic flow data with the first preset traffic flow threshold; if the first traffic flow data is lower than the first preset traffic flow threshold, it is judged that the first traffic flow data meets conditions for establishing the virtual parking spaces, and first establishment information is generated; if the first traffic flow data is not lower than the first preset traffic flow threshold, it is judged that the first traffic flow data does not meet conditions for establishing the virtual parking spaces, and third judgment information is generated;

the second judging unit is used for comparing and analyzing the second traffic flow data with the second preset traffic flow threshold; if the second traffic flow data is lower than the second preset traffic flow threshold, it is judged that the second traffic flow data meets conditions for establishing the virtual parking spaces and second establishment information is generated; if the second traffic flow data is not lower than the second preset traffic flow threshold, it is judged that the second traffic flow data does not meet conditions for establishing the virtual parking spaces and fourth judgment information is generated.

Optionally, the virtual parking spaces are established under a condition that both the first establishment information and the second establishment information exist at the same time is met;

the virtual parking spaces are not established or the established virtual parking spaces are canceled under a condition that the third judgment information or the fourth judgment information exists is met.

Optionally, the client is used to display the virtual parking spaces established by the parking space control module;

the client is also used to prompt users that the established virtual parking spaces are canceled, and prompt the customers to move the vehicles.

Optionally, the virtual parking space establishment system further includes a data recording module;

the data recording module is used for record historical comprehensive data, where the historical comprehensive data includes historical traffic flow data and historical virtual parking space establishment or cancellation data.

The parking space control module also establishes or cancels the virtual parking spaces according to the historical comprehensive data.

On the other hand, in order to achieve the above objectives, the application provides the virtual parking space establishment method based on multi-source data fusion, including following steps:

S1, acquiring traffic flow data, including acquiring first traffic flow data and second traffic flow data, where the first traffic flow data is real-time traffic flow data of vehicles passing through a geomagnetic sensing unit and the second traffic flow data is all real-time traffic flow data on roads;

S2, processing and analyzing the traffic flow data, including comparing the first traffic flow data with a first preset traffic flow threshold, where if the first traffic flow data is lower than the first preset traffic flow threshold, judging that the first traffic flow data meets conditions for establishing virtual parking spaces, and generating first establishment information; if the first traffic flow data is not lower than the first preset traffic flow threshold, judging that the first traffic flow data does not meet conditions for establishing the virtual parking spaces, and generating third judgment information;

comparing and analyzing the second traffic flow data with a second preset traffic flow threshold, where if the second traffic flow data is lower than the second preset traffic flow threshold, judging that the second traffic flow data meets conditions for establishing the virtual parking spaces and generating second establishment information; if the second traffic flow data is not lower than the second preset traffic flow threshold, judging that the second traffic flow data does not meet conditions for establishing the virtual parking spaces and generating fourth judgment information;

S3, establishing or canceling the virtual parking spaces according to analysis results of the traffic flow data, including:

establishing the virtual parking spaces under a condition that both the first establishment information and the second establishment information exist at the same time is met;

not establishing the virtual parking spaces or canceling established virtual parking spaces under a condition that the third judgment information or the fourth judgment information exists is met;

S4, displaying an establishment or cancellation of the virtual parking spaces to users, including:

displaying the virtual parking spaces established by the parking space control module, prompting the users that the established virtual parking spaces are canceled, and prompting the customers to move the vehicles.

Optionally, the virtual parking space establishment method further includes:

establishing or canceling the virtual parking spaces according to historical comprehensive data, where the historical comprehensive data includes historical traffic flow data and historical virtual parking space establishment or cancellation data.

Compared with the prior art, the application has following advantages and technical effects.

According to the application, the real-time traffic flow on the roads is accurately identified through geomagnetic sensing and high-definition video, and a virtual parking space establishment period and a virtual parking space cancellation period are automatically and effectively divided through comparing the real-time traffic flow data with the set traffic flow thresholds. Further, by setting the conditions for establishing and canceling the virtual parking spaces, the establishment and cancellation of virtual parking spaces completely follow the change of real-time traffic flow on the roads, and the utilization rate of road resources is improved to the greatest extent on the premise of ensuring smooth roads.

BRIEF DESCRIPTION OF THE DRAWINGS

The drawings that form a part of this application are used to provide a further understanding of this application. The illustrative embodiments of this application and their descriptions are used to explain this application, and do not constitute undue limitations on this application. In the attached drawings.

DETAILED DESCRIPTION OF THE EMBODIMENTS

It should be noted that the embodiments in this application and the features in the embodiments may be combined with each other without conflict. The application will be described in detail with reference to the drawings and embodiments.

It should be noted that the steps shown in the flowchart of the figure can be executed in a computer system such as a set of computer-executable instructions, and although a logical sequence is shown in the flow chart, in some cases, the steps shown or described may be executed in a sequence different from that here.

Embodiment 1

Figure 1:
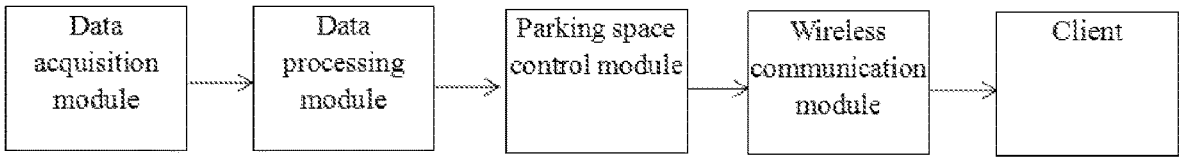
FIG. 1 is a schematic structural diagram of a virtual parking space establishment system based on multi-source data fusion in embodiment 1 of the present application.

As shown in FIG. 1, this embodiment provides a virtual parking space establishment system based on multi-source data fusion, including a data acquiring module, a data processing module, a parking space control module, a wireless communication module, and a client.

The data acquiring module is used for acquiring traffic flow data.

In an embodiment, the data acquiring module includes a geomagnetic sensing unit and a high-definition camera unit.

The geomagnetic sensing unit is used for acquiring first traffic flow data through real-time geomagnetic induction, where the first traffic flow data is traffic flow data of vehicles passing through the geomagnetic sensing unit.

The high-definition camera unit is used for acquiring second traffic flow data through real-time video monitoring, where the second traffic flow data is all traffic flow data on roads.

In this embodiment, the geomagnetic sensing unit is a geomagnetic sensor installed under the roads, and the geomagnetic sensor is preferentially arranged in a roadside lane, and at least one lane is arranged, and collected first traffic flow data is traffic flow data of vehicles passing through the lane provided with the geomagnetic sensor; collected second traffic flow data is all traffic flow data of the lane with at least single way, including the lane where the geomagnetic sensor is installed, collected by high-definition cameras on the roads.

The data processing module is used for processing and analyzing the traffic flow data.

In an embodiment, the data processing module includes a first judging unit, a second judging unit and a threshold setting unit.

The threshold setting unit is used for setting a first preset traffic flow threshold and a second preset traffic flow threshold;

The first judging unit is used for comparing the first traffic flow data with the first preset traffic flow threshold; if the first traffic flow data is lower than the first preset traffic flow threshold, it is judged that the first traffic flow data meets conditions for establishing the virtual parking spaces, and first establishment information is generated; if the first traffic flow data is not lower than the first preset traffic flow threshold, it is judged that the first traffic flow data does not meet conditions for establishing the virtual parking spaces, and third judgment information is generated.

The second judging unit is used for comparing and analyzing the second traffic flow data with the second preset traffic flow threshold; if the second traffic flow data is lower than the second preset traffic flow threshold, it is judged that the second traffic flow data meets conditions for establishing the virtual parking spaces and second establishment information is generated; if the second traffic flow data is not lower than the second preset traffic flow threshold, it is judged that the second traffic flow data does not meet conditions for establishing the virtual parking spaces and fourth judgment information is generated.

In this embodiment, the collected traffic flow data are respectively set with traffic flow thresholds. When the traffic flow data passing through the lane with geomagnetic sensor is less than set corresponding traffic flow thresholds, the system automatically judges that the traffic flow data on this lane meets the conditions for establishing virtual parking spaces, and sends out the first establishment information of allowing the establishment of virtual parking spaces. When the traffic flow data passing through the lane with geomagnetic sensor is not less than the set corresponding traffic flow thresholds, the system automatically judges that the traffic flow data in this lane does not meet the conditions for establishing the virtual parking spaces, and sends out the third judgment information of not establishing or canceling the virtual parking spaces.

When all the traffic flow data of a single-way lane is lower than corresponding preset traffic flow threshold of the single-way lane, the system automatically judges that all the traffic flow data of the single-way lane at this time meet the conditions of establishing virtual parking spaces, and generates second establishment information of allowing virtual parking spaces to be established. When all the traffic flow data of the single-way lane is not lower than corresponding preset traffic flow threshold of the single-way lane, the system automatically judges that all the traffic flow data of the single-way lane at this time do not meet the conditions of establishing virtual parking spaces, and generates fourth judgment information of not establishing or canceling virtual parking spaces.

The parking space control module is used for establishing or canceling virtual parking spaces according to analysis results of the traffic flow data.

In an embodiment, the virtual parking spaces are established under a condition that both the first establishment information and the second establishment information exist at the same time is met.

The virtual parking spaces are not established or established virtual parking spaces are canceled under a condition that the third judgment information or the fourth judgment information exists is met.

In an embodiment, the parking space control module establishes or cancels the virtual parking spaces according to the first establishment information, the third judgment information, the second establishment information and the fourth judgment information generated by the data processing module. Specifically, the parking space control module establishes the virtual parking spaces only when the first establishment information and the second establishment information exist at the same time, and does not establish or cancel the established virtual parking spaces when one or both of the third judgment information and the fourth judgment information exist.

This application also includes the wireless communication module used for providing a wireless network link between the client and the parking space control module.

This application also includes the client used for viewing virtual parking space information.

In an embodiment, the client is used to display the virtual parking spaces established by the parking space control module.

The client is also used to prompt users that the established virtual parking spaces are canceled, and prompt the customers to move the vehicles.

In this embodiment, the users check information of nearby virtual parking spaces through the client, and the client guides the users to park in the same way as physical parking spaces. When established free virtual parking spaces are found, the users are also allowed to reserve the virtual parking spaces at the client. For the convenience of other users, the client starts timing from a moment of reservation of the users. When the users fail to park the vehicle in the virtual parking spaces after a period of time, the system sends a prompt to the users to cancel the reserved virtual parking spaces through the client, and cancels the reservation within a short time after the prompt.

When the system decides to cancel the virtual parking spaces and there are vehicles in the virtual parking spaces, the system sends the information of canceling the establishment of the virtual parking spaces to the users through the client, and prompts the users at least twice with the information prompt or voice call prompt in the client. If the users have not taken the vehicles away beyond a certain time range, the information is sent to a traffic department for processing.

The virtual parking space establishment system further includes a data recording module.

In an embodiment, the data recording module is used for record historical comprehensive data, where the historical comprehensive data includes historical traffic flow data and historical virtual parking space establishment or cancellation data.

The parking space control module also establishes or cancels the virtual parking spaces according to the historical comprehensive data.

In this embodiment, the data recording module records all traffic flow data and virtual parking space establishment or cancellation data.

The virtual parking space establishment system of the application also establishes or cancels the virtual parking spaces in advance according to the historical comprehensive data recorded by the data recording module. For example, if the virtual parking spaces are established or canceled frequently in a certain road in a certain period of time in a day, the virtual parking spaces may be established or canceled in advance according to the historical data experience. For example, in a period from 2:00 pm to 4:00 pm, according to the records of historical data, the traffic flow on the road during this period for three consecutive days or more is less than the set threshold and the conditions for establishing virtual parking spaces are met. If virtual parking spaces are established, it may be predicted that the traffic flow will decrease at least in the period from 2:00 pm to 4:00 pm on the fourth day, and the conditions for establishing virtual parking spaces are met. Therefore, the virtual parking spaces are established in advance. Once the real-time traffic flow on the roads does not meet the conditions for establishing virtual parking spaces (that is, meeting the conditions for not establishing virtual parking spaces or canceling the established virtual parking spaces), the system immediately cancels the established virtual parking spaces, or does not establish the virtual parking spaces when virtual parking spaces are not established.

Embodiment 2

Figure 2:
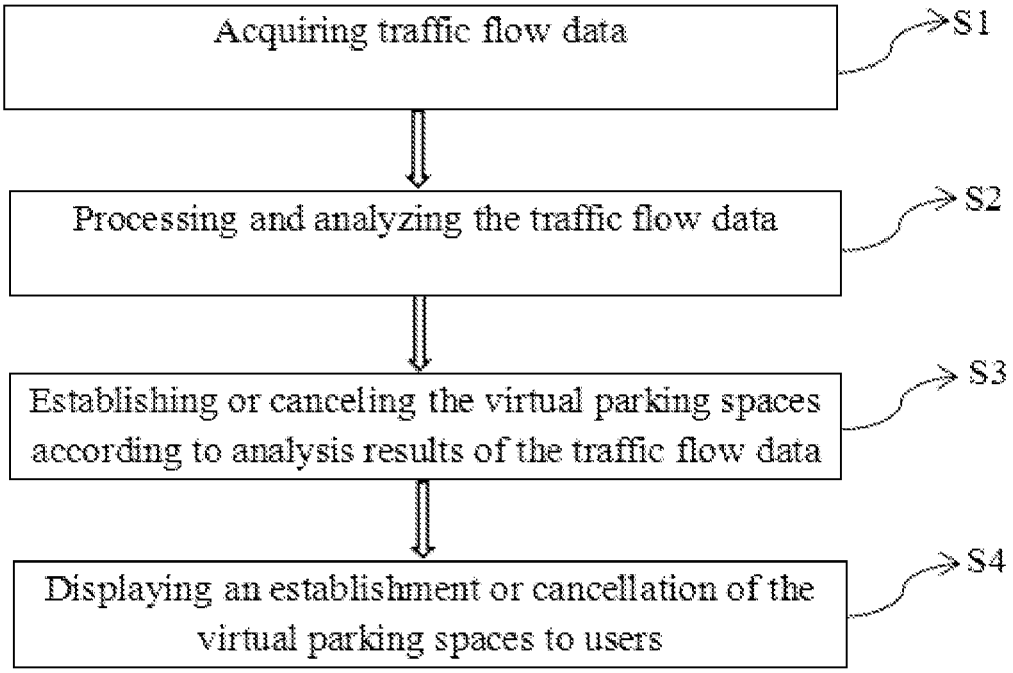
FIG. 2 is a flow chart of a virtual parking space establishment method based on multi-source data fusion in embodiment 2 of the present application.

As shown in FIG. 2, this embodiment provides a virtual parking space establishment method based on multi-source data fusion, including following steps:

S1, acquiring traffic flow data, including acquiring first traffic flow data and second traffic flow data, where the first traffic flow data is real-time traffic flow data of vehicles passing through a geomagnetic sensing unit and the second traffic flow data is all real-time traffic flow data on roads;

S2, processing and analyzing the traffic flow data, including comparing the first traffic flow data with a first preset traffic flow threshold, where if the first traffic flow data is lower than the first preset traffic flow threshold, judging that the first traffic flow data meets conditions for establishing virtual parking spaces, and generating first establishment information; if the first traffic flow data is not lower than the first preset traffic flow threshold, judging that the first traffic flow data does not meet conditions for establishing the virtual parking spaces, and generating third judgment information;

comparing and analyzing the second traffic flow data with a second preset traffic flow threshold, where if the second traffic flow data is lower than the second preset traffic flow threshold, judging that the second traffic flow data meets conditions for establishing the virtual parking spaces and generating second establishment information; if the second traffic flow data is not lower than the second preset traffic flow threshold, judging that the second traffic flow data does not meet conditions for establishing the virtual parking spaces and generating fourth judgment information;

S3, establishing or canceling the virtual parking spaces according to analysis results of the traffic flow data, including:

establishing the virtual parking spaces under a condition that both the first establishment information and the second establishment information exist at the same time is met;

not establishing the virtual parking spaces or canceling established virtual parking spaces under a condition that the third judgment information or the fourth judgment information exists is met;

S4, displaying an establishment or cancellation of the virtual parking spaces to users, including:

displaying the virtual parking spaces established by the parking space control module, prompting the users that the established virtual parking spaces are canceled, and prompting the customers to move the vehicles.

In an embodiment, the virtual parking space establishment method further includes:

establishing or canceling the virtual parking spaces according to historical comprehensive data, where the historical comprehensive data includes historical traffic flow data and historical virtual parking space establishment or cancellation data.

The above are only the preferred embodiments of this application, but the scope of protection of this application is not limited to this. Any changes or substitutions that can be easily thought of by those skilled in the technical field within the technical scope disclosed in this application should be covered by the scope of protection of this application. Therefore, the scope of protection of this application should be based on the scope of protection of the claims.

What is claimed is:

1. A virtual parking space establishment method based on multi-source data fusion, comprising following steps:

acquiring traffic flow data, comprising: acquiring first traffic flow data and second traffic flow data, wherein the first traffic flow data is real-time traffic flow data of vehicles passing through a geomagnetic sensing unit and the second traffic flow data is all real-time traffic flow data on roads;

processing and analyzing the traffic flow data, comprising:

comparing the first traffic flow data with a first preset traffic flow threshold, wherein if the first traffic flow data is lower than the first preset traffic flow threshold, judging that the first traffic flow data meets conditions for establishing virtual parking spaces, and generating first establishment information; if the first traffic flow data is not lower than the first preset traffic flow threshold, judging that the first traffic flow data does not meet conditions for establishing the virtual parking spaces, and generating third judgment information;

comparing and analyzing the second traffic flow data with a second preset traffic flow threshold, wherein if the second traffic flow data is lower than the second preset traffic flow threshold, judging that the second traffic flow data meets conditions for establishing the virtual parking spaces and generating second establishment information; if the second traffic flow data is not lower than the second preset traffic flow threshold, judging that the second traffic flow data does not meet conditions for establishing the virtual parking spaces and generating fourth judgment information;

establishing or canceling the virtual parking spaces according to analysis results of the traffic flow data, comprising:

establishing the virtual parking spaces when the first establishment information and the second establishment information exist at the same time;

not establishing the virtual parking spaces or canceling established virtual parking spaces when the third judgment information or the fourth judgment information exists; and displaying an establishment or cancellation of the virtual parking spaces to users, comprising:

displaying the virtual parking spaces established by the parking space control module, prompting the users that the established virtual parking spaces are canceled, and prompting the customers to move the vehicles.

2. The virtual parking space establishment method based on multi-source data fusion according to claim 1, wherein the virtual parking space establishment method further comprises:

establishing or canceling the virtual parking spaces according to historical comprehensive data, wherein the historical comprehensive data comprises historical traffic flow data and historical virtual parking space establishment or cancellation data.

* * * * *